US009070288B2

(12) United States Patent
Lee et al.

(10) Patent No.: US 9,070,288 B2
(45) Date of Patent: Jun. 30, 2015

(54) APPARATUS AND METHOD FOR CHOOSING PRIORITY CONTROL OBJECT, AND APPARATUS FOR CONTROLLING OBJECT

(75) Inventors: Byung Gil Lee, Daejeon (KR); Jong Wook Han, Daejeon (KR); Hyun Sook Cho, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 155 days.

(21) Appl. No.: 13/451,405

(22) Filed: Apr. 19, 2012

(65) Prior Publication Data

US 2012/0271538 A1 Oct. 25, 2012

(30) Foreign Application Priority Data

Apr. 21, 2011 (KR) ..... 10-2011-0037330

(51) Int. Cl.
*G08G 3/02* (2006.01)
*G08G 9/02* (2006.01)

(52) U.S. Cl.
CPC ... *G08G 3/02* (2013.01); *G08G 9/02* (2013.01)

(58) Field of Classification Search
CPC ..... G08G 3/02; G08G 9/02
USPC ..... 701/120, 117, 300–302; 340/903, 340/995.19, 3.41
See application file for complete search history.

(56) References Cited

U.S. PATENT DOCUMENTS

| | | | | |
|---|---|---|---|---|
| 6,546,338 | B2 * | 4/2003 | Sainthuile et al. | 701/301 |
| 6,587,757 | B2 * | 7/2003 | Sainthuile | 701/1 |
| 8,090,525 | B2 * | 1/2012 | Villiers | 701/120 |
| 2008/0097699 | A1 * | 4/2008 | Ono | 701/300 |
| 2011/0210865 | A1 * | 9/2011 | Lee et al. | 340/903 |
| 2012/0072990 | A1 * | 3/2012 | Gutt et al. | 726/25 |

FOREIGN PATENT DOCUMENTS

KR 1020090009418 A 1/2009

* cited by examiner

*Primary Examiner* — Helal A Algahaim
*Assistant Examiner* — Nga X Nguyen

(57) ABSTRACT

Provided are an apparatus and a method that chooses an object to be preferentially controlled based on an accident risk degree and hazard and controls the chosen object. In the present invention, it is possible to choose and control a ship having high hazard calculated with trajectory prediction, current operation state information, and past history information under a traffic situation in which the ships are concentrated, by priority. The ship having high hazard is chosen by calculating and applying various history information including an accident record, an entry history of an operator, an aging degree history of the ship, and a steering feature history by using a collision risk on a real-time trajectory collision risk and past history information and different warnings are given during a control for each level.

16 Claims, 7 Drawing Sheets

FIG. 4

| HAZARD PRIORITY | TYPE OF SHIP | WEIGHT DEPENDING ON ESTIMATED DAMAGE |
|---|---|---|
| 1 | VLCC(LARGE-SIZED OIL BANKER) | 2.0 |
| 2 | PASSENGER SHIP | 1.9 |
| 3 | WIG SHIP | 1.7 |
| 4 | CHEMICAL SHIP | 1.6 |
| 5 | GENERAL OIL TRANSPORTATION SHIP | 1.6 |
| 6 | LNG/LPG SHIP | 1.5 |
| 7 | CONTAINER SHIP | 1.3 |
| 8 | WARSHIP | 1.1 |
| 9 | CAR CARRIER | 1.0 |
| 10 | GUARD SHIP | 0.8 |
| 11 | SHIP DRAGGED OR CONVEYED WHILE LOADING LARGE-SIZED STRUCTURE | 0.6 |
| 12 | BARGE | 0.5 |
| 13 | SMALL-SIZED FISHING BOAT | 0.3 |
| 14 | SMALL-SIZED BOAT AND YACHT | 0.2 |

APPARATUS AND METHOD FOR CHOOSING PRIORITY CONTROL OBJECT, AND APPARATUS FOR CONTROLLING OBJECT

CROSS-REFERENCE TO RELATED APPLICATIONS

This application claims priority to and the benefit of Korean Patent Application No. 10-2011-0037330 filed in the Korean Intellectual Property Office on Apr. 21, 2011, the entire contents of which are incorporated herein by reference.

TECHNICAL FIELD

The present invention relates to an apparatus and a method for choosing a priority control object that chooses an object to be controlled by priority. The present invention also relates to an apparatus for controlling an object that chooses an object to be controlled by priority and thereafter, controls management objects based on a chosen result.

BACKGROUND ART

In order to prevent collision between ships during sailing at sea, in the related art, a controller intensively observes a control screen displaying the positions of the ships, predicts a collision likelihood between the ships by verifying an inter-ship distance by making use of controller's experience, and performs a sea traffic control by controlling sailing paths of the corresponding ships when it is judged that the collision likelihood is high.

However, since the control method is subjectively performed depending on the controller's experience, an accident occurrence risk continuously exists and since the sailing paths of the corresponding ships are not considered at all, a lot of limits are accompanied in performing more accurate control.

Since the controller should intensively observe a sea situation every hour, a fatigue degree increases as working hours are continued, and as a result, the controller is frequently careless.

Meanwhile, in recent years, with development of a marine wireless communication technology, the ship has been able to transmit ship information including ship's own identification information to a control center by using an automatic identification system (AIS), a control center has been able to definitely determine what kind of ship is a ship that exists at a predetermined position at sea. In general, a current position of a ship or an airplane is displayed in a map on a control screen of the control center and the ship name or airplane name is briefly displayed next to the current position.

However, in this control method, the position where the ship exists and the ship name of the corresponding ship can just be verified, but a scheme to control the corresponding ship based on the sailing path of the corresponding ship is not provided, and as a result, the control method is not significantly different from the control method in the case in which the control method depends on the controller's experience. That is, the controller should still predict the inter-ship collision likelihood by intensively observing the control screen displaying the position of the ship and verifying the positions of the ships and the inter-ship distance based on his/her own working experience.

SUMMARY OF THE INVENTION

The present invention has been made in an effort to provide an apparatus and a method for choosing a priority control object and an apparatus for controlling an object that estimate anticipated sailing paths of ships and provide the estimated path to a controller. The present invention also has been made in an effort to propose an apparatus and a method for choosing a priority control object and an apparatus for controlling an object that automatically anticipate an accident scenario and sense the collision likelihood and transfer the collision likelihood to a controller in advance when an inter-ship collision likelihood exists.

The present invention has been made in an effort to provide systematic control system and method that can support controller's decision making by calculating differentiated information associated with an object having a relatively high risk element and achieving differentiated control by calculating a degree of risk of an object in control and judging significance thereof, in order to prevent a traffic accident when ships, vehicles, and airplanes are operated. That is, there are proposed an apparatus and a method in which history information of the control target is utilized in control, the history information is combined with current situation information, a priority control object of a ship is chosen through a combination of past, present, and future information to calculate a collision risk degree from an anticipation trajectory, and the control object is applied to the control to be utilized.

The present invention has been made in an effort to provide an apparatus for choosing a priority control object, including: a path estimating unit estimating a movement path of a designated first moving body; a scenario predicting unit predicting an accident scenario which can occur on the movement path of the first moving body based on a previously acquired movement path of at least one second moving body; a risk calculating unit calculating a first risk associated with an accident occurrence likelihood of each moving body based on the accident scenario predicted for each moving body; and a priority control object choosing unit finally choosing a priority control object a highest risk degree among all moving bodies in which the first risk is calculated when the first risk is calculated with respect to at least one second moving body including the first moving body.

The apparatus may further include a risk assuming unit assuming the second risk associated with the damage scale of each moving body or the environmental loss value depending on the damage of the moving body with respect to all the moving bodies in which the first risk is calculated.

The apparatus may further include a history analyzing unit of analyzing at least one of a first history associated with the moving body for each moving body in which the accident scenario is assumed, a second history associated with a spot positioned on a movement path of the moving body, and a third history associated with a person who operates the moving body. The priority control object choosing unit may synthesize the first risk and the second risk at the time of choosing the priority control object or synthesize the first risk and the second risk to which the weight is reflected after reflecting the weight to each of the first risk and the second risk. The priority control object choosing unit may reflect a larger weight to the second risk than the first risk.

The apparatus may further include a situation information acquiring unit acquiring current situation information at a spot positioned on the movement path of the control object moving body. The risk calculating unit may digitize a result acquired by analyzing at least one history to reflect the analysis result to the first risk at the time of calculating the first risk.

The risk calculating unit may calculate the first risk by using a distance of the closet point of approach (DCPA) or a time to the closet point of approach (TCPA). The risk calculating unit may calculate the first risk by using additional factors (ex. an exist probability of a cross point, judgment whether there is a narrow channel, that is, a course passed always closely, and the like) in addition to the DCPA and the TCPA. The risk calculating unit may calculate different risk conditions for each situation.

The priority control object choosing apparatus may be provided in the traffic control center which can communicate with the first moving body and the second moving body.

The path estimating unit may estimate the movement path of the first moving body based on a current position of the first moving body, and the path estimating unit may include a path estimating unit measuring the current position of the first moving body every predetermined time; and a movement path estimating/adjusting unit estimating the movement path of the first moving body and adjusting an estimated movement path of the first moving body whenever the current position of the first moving body is measured.

The priority control object choosing unit may include: a list generating portion generating a priority list in which all the moving bodies in which the first risk is calculated are arranged according to a predetermined priority reference; and a reference conformance object choosing portion choosing the priority control object in accordance with a predetermined choosing reference from the priority list.

Another exemplary embodiment of the present invention provides a method for choosing a priority control objection, including: estimating a movement path of a designated first moving body; predicting an accident scenario which can occur on the movement path of the first moving body based on a previously acquired movement path of at least one second moving body; calculating a first risk associated with the accident occurrence likelihood of each moving body based on the accident scenario predicted for each moving body; and choosing a priority control object among all moving bodies in which the first risk is calculated when the first risk is calculated with respect to at least one second moving body including the first moving body.

The method may further include assuming a second risk associated with the damage scale of each moving body or the environmental loss value depending on the damage of the moving body with respect to all the moving bodies in which the first risk is calculated.

The method may further include analyzing at least one of a first history associated with the moving body for each moving body in which the accident scenario is assumed, a second history associated with a spot positioned on a movement path of the moving body, and a third history associated with a person who operates the moving body. In the choosing of the priority control object, the first risk and the second risk may be synthesized with each other at the time of choosing the priority control object, or the first risk and the second risk to which the weight is reflected may be synthesized with each other after reflecting the weight to each of the first risk and the second risk. In the choosing of the priority control object, a larger weight may be reflected to the second risk than the first risk.

The method may further include acquiring current situation/state information at a spot positioned on the movement path of the control object moving body. In the risk calculating, a result acquired by analyzing at least one history is digitized to reflect the analysis result to the first risk at the time of calculating the first risk.

In the risk calculating, the first risk may be calculated by using a distance of the closet point of approach (DCPA) or a time to the closet point of approach (TCPA).

The priority control object choosing method may be performed in a traffic control center which can communicate with the first moving body and the second moving body.

The path estimating may include estimating the movement path of the first moving body based on a current position of the first moving body and measuring the current position of the first moving body every predetermined time; and estimating the movement path of the first moving body and adjusting an estimated movement path of the first moving body whenever the current position of the first moving body is measured.

The priority control object choosing may include: generating a priority list in which all the moving bodies in which the first risk is calculated are arranged according to a predetermined priority reference; and choosing a priority control object in accordance with a predetermined choosing reference from the priority list.

Yet another exemplary embodiment of the present invention provides an apparatus for controlling an object, including: a path estimating unit estimating a movement path of a designated first moving body; a scenario predicting unit predicting an accident scenario which can occur on the movement path of the first moving body based on a previously acquired movement path of at least one second moving body; a risk calculating unit calculating a first risk associated with an accident occurrence likelihood of each moving body based on the accident scenario predicted for each moving body; a priority control object choosing unit choosing a priority control object among all moving bodies in which the first risk is calculated when the first risk is calculated with respect to at least one second moving body including the first moving body; and a moving body controlling unit performing a first control to estimate again the movement paths of all the moving bodies in which the first risk is calculated based on the current positions of all the moving bodies in which the first risk is calculated every predetermined time, performing a second control to calculate again the first risks of all the moving bodies in which the first risk is calculated, and continuously controlling all the moving bodies in which the first risk is calculated by using the result acquired according to the first control and the second control.

The apparatus may further include: a decision-making support data generating unit generating decision-making support data associated with whether there is the accident occurrence likelihood with respect to all the moving bodies in which the first risk is calculated based on the result acquired according to the first control and the second control; an accident likelihood extracting unit extracting moving bodies having the accident occurrence likelihood from all the moving bodies in which the first risk is calculated based on the decision-making support data; and a decision-making supporting unit sending a warning message or providing the decision-making support data to the extracted moving bodies. The decision-making supporting unit may send an accident caution message to at least one moving body positioned within a predetermined distance from the moving body chosen as the priority control target.

The moving body controlling unit may control the priority control object to be again chosen whenever continuously controlling all the moving bodies in which the first risk is calculated.

The moving body controlling unit may notify, to the controller, a risk calculation result synthetically judged with the result acquired according to the first control and the second control in different warning level and method. The moving body controlling unit may dynamically generate and manage a blacklist based on the risk calculation result, and induce an active control method as well as giving a warning to other moving bodies within a control range when the moving bodies included in the blacklist appear within the control range.

According to exemplary embodiments of the present invention, an accident of an airplane or a ship can be prevented and an appropriate measure for preventing the accident can be taken. In more detail, anticipated sailing paths of ships are estimated and provided to a controller, such that a controller can perform more accurate control. An accident scenario is automatically anticipated and when an inter-ship collision likelihood exists, the collision likelihood is sensed and transferred to a controller in advance, thereby preventing the inter-ship collision.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

FIG. 4 is an exemplified diagram of a list acquired by calculating a hazard priority with respect to ships.

Figure 1:
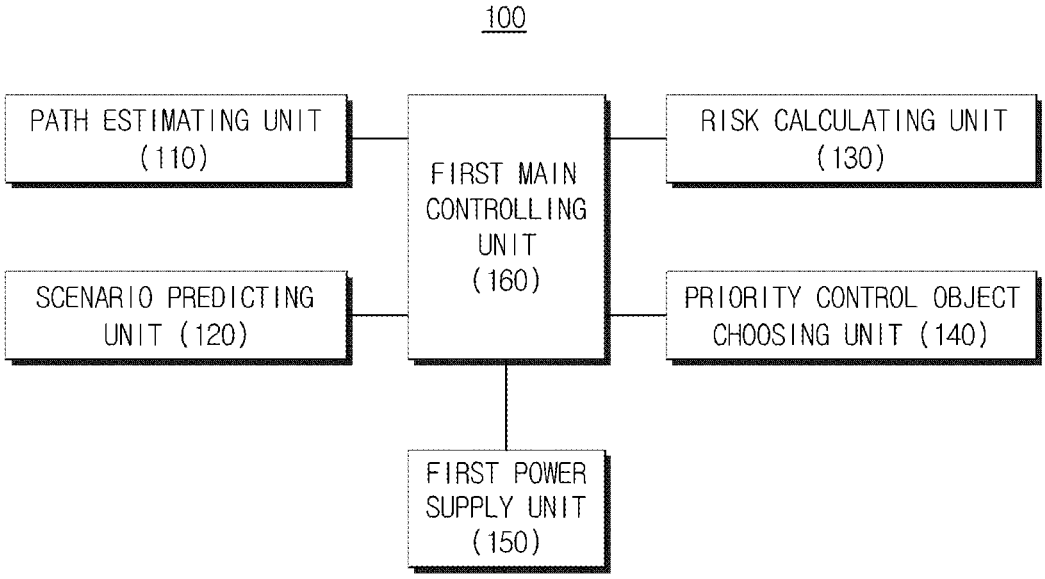
FIG. 1 is a block diagram schematically showing an apparatus for choosing a priority control object according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter, exemplary embodiments of the present invention will be described in detail with reference to the accompanying drawings. In the specification, in adding reference numerals to components throughout the drawings, it is to be noted that like reference numerals designate like components even though components are shown in different drawings. In describing a preferred embodiment of the present invention, well-known functions or constructions will not be described in detail since they may unnecessarily obscure the understanding of the present invention. Hereinafter, the exemplary embodiment of the present invention will be described, but it will be understood to those skilled in the art that the spirit and scope of the present invention are not limited thereto and various modifications and changes can be made.

Figure 2A:
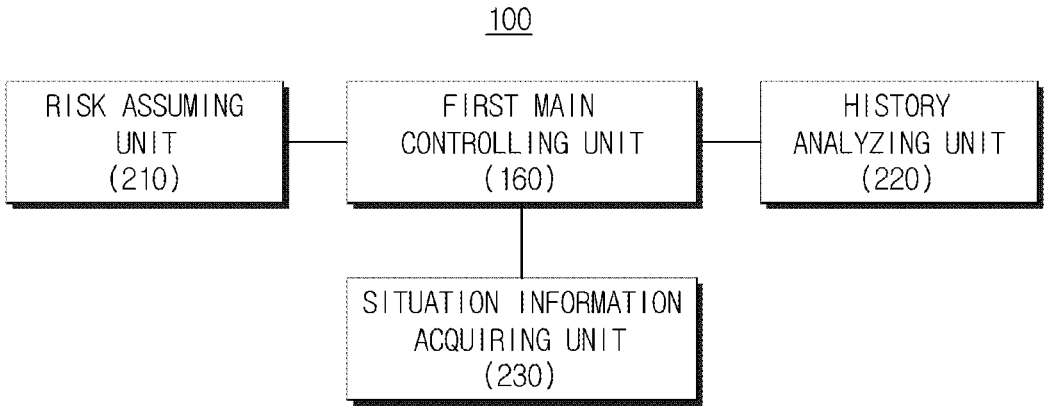
FIGS. 2A to 2C is a block diagram showing, in detail, an internal configuration of the apparatus for choosing a priority control object according to the exemplary embodiment of the present invention.
Figure 2B:
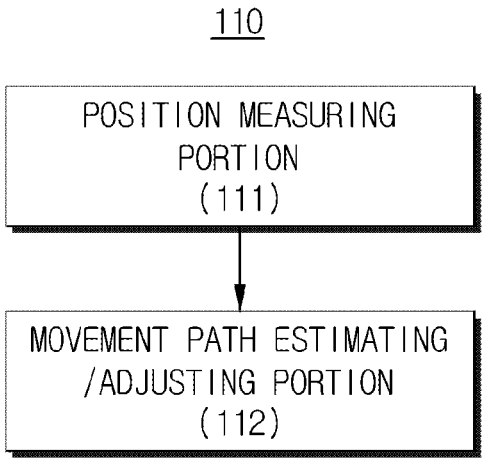
Figure 2C:
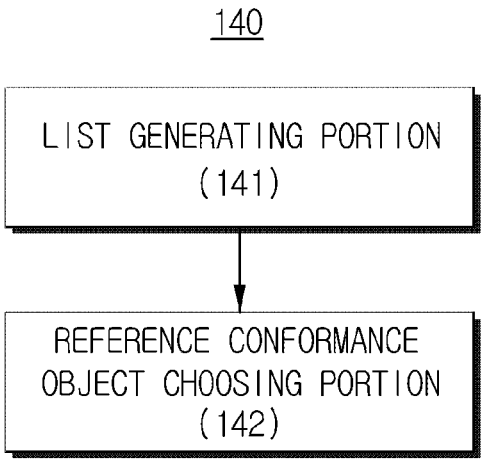

FIG. 1 is a block diagram schematically showing an apparatus for choosing a priority control object according to an exemplary embodiment of the present invention. FIGS. 2A to 2C is a block diagram showing, in detail, an internal configuration of the apparatus for choosing a priority control object according to the exemplary embodiment of the present invention. The following description will be made with reference to FIGS. 1 to 2C.

The priority control object choosing apparatus 100 according to the exemplary embodiment is associated with a safety technology for reducing a risk of an accident which may occur at the time of operating a ship, an airplane, and a vehicle. In the following description, generally, the ship will be described as an example. The reason is that other objects are also similarly controlled and only when one object is described, clear analysis can be achieved.

In the case of a ship, an airplane, and a vehicle, an accident is caused by a lot of mistakes of an operator. First, the priority control object choosing apparatus 100 estimates anticipated sailing paths of ships and provides the estimated paths to a controller, and as a result, the controller may perform more accurate control. The priority control object choosing apparatus 100 automatically anticipates an accident scenario and senses the collision likelihood and transfers the collision likelihood to the controller in advance when an inter-ship collision likelihood exists, thereby preventing the inter-ship collision. The priority control object choosing apparatus 100 proposes even a method for more accurately tracking the position of the object during amalgamation in which the received information is recognized as the same target position, by sensing the ship with a radar and sensing real-time positional information thereof from another radar site.

In the case of the ship, different damaging effects due to respective accident exist in accidents including the inter-ship collision. For example, damaging effects in the case where oil leaks due to a collision with a large-sized oil tanker and in the case of a collision between small-sized fishing boats are significantly different. For this reason, dangerous situations may frequently occur at the same time and all dangers may not be handled similarly. Therefore, the priority control object choosing apparatus 100 chooses a blacklist ship having a high risk degree by synthetically considering damage due to the accident of the ship and an accident occurrence likelihood and proposes a scheme to perform a concentrated control thereof.

The priority control object choosing apparatus 100 includes a path estimating unit 110, a scenario predicting unit 120, a risk calculating unit 130, a priority control object choosing unit 140, a first power supply unit 150, and a first main control unit 160.

The path estimating unit 110 performs a function of estimating a movement path of a designated first moving body. The path estimating unit 110 may use a radar system or an automatic identification system (AIS) at the time of estimating the movement path of the first moving body.

The path estimating unit 110 estimates the movement path of the first moving body based on a current position of the first moving body. By considering it, the path estimating unit 110 may include a position measurement unit 111 and a movement path estimating/adjusting unit 112 as shown in FIG. 2B. The path estimating unit 111 performs a function of measuring the current position of the first moving body for every predetermined time. The movement path estimating/adjusting unit 112 estimates the movement path of the first moving body and performs a function of adjusting an estimated movement path of the first moving body whenever the current position of the first moving body is measured. Meanwhile, whenever the estimated movement path of the first moving body is adjusted, the risk calculating unit 130 preferably modifies a calculated risk of the first moving body.

The reason is to accurately choose a priority control object by accurately determining a control priority with respect to control objects and minimize damages to the control objects therefrom.

The scenario predicting unit 120 performs a function of predicting an accident scenario which may occur on the movement path of the first moving body based on a previously acquired movement path of at least one second moving body. The scenario predicting unit 120 may predict the accident scenario by estimating the current position of each moving body on the movement path by a predetermined time interval (ex. 30 sec., 10 min., and 1 hr) in order to determine whether there is an accident occurrence likelihood between a target moving body (first moving body) and other moving bodies (second moving body). However, the accident scenario predicting method is not limited thereto in the exemplary embodiment.

When a predetermined moving body is designated as the first moving body among a plurality of moving bodies positioned on the sea, the land, and the air, the second moving body may be selected from the rest of the moving bodies. Of course, all other moving bodies may be selected as the second moving body. The first moving body and the second moving body are generally positioned at a predetermined area selected on the land, in the sea, and in the air together, but may be positioned at different areas.

The risk calculating unit 130 performs a function of calculating a first risk associated with the accident occurrence likelihood of each moving body based on the predicted accident scenario for each moving body.

The first risk is defined as the accident occurrence probability enough to damage the moving body and a likelihood thereof. The risk calculating unit 130 substitutes the first risk into a predetermined table to calculate the first risk as a predetermined value. An example of calculating the first risk will be described below.

The risk calculating unit 130 calculates the first risk by using a distance of the closet point of approach (DCPA) or a time to the closet point of approach (TCPA). Preferably, the risk calculating unit 130 may calculate the first risk by reflecting a weight to the DCPA, TCPA, and other collision risk degree elements. Other collision risk degree elements include additional factors (ex. an existible probability of a cross point and judgment whether there is a narrow channel, that is, a course passed always closely, and the like).

The priority control object choosing unit 140 performs a function of choosing the priority control object among all moving bodies in which the first risk is calculated when the first risk is calculated with respect to at least one second moving body including the first moving body.

The priority control object choosing unit 140 may include a list generating portion 141 and a reference conformance object choosing portion 142 as shown in FIG. 2C. The list generating portion 141 performs a function of generating a priority list in which all the moving bodies in which the first risk is calculated are arranged according to a predetermined priority reference. The reference conformance object choosing portion 142 performs a function of choosing a priority control object which conforms to a predetermined choosing reference from the priority list. In the exemplary embodiment, for example, a size value of the risk may be the priority reference. However, in the exemplary embodiment, the priority reference needs not be limited to the size value of the risk. Meanwhile, the choosing reference may be, for example, a moving body having the highest priority, moving bodies up to upper n-th (n is a natural number) priority, and the like. Of course, the choosing reference is not particularly limited thereto. An example of the priority list will be described below with reference to FIG. 4.

The priority control object choosing unit 140 may synthesize the first risk and the second risk at the time of choosing the priority control object or synthesize the first risk and the second risk to which the weight is reflected after reflecting the weight to each of the first risk and the second risk. For example, the priority control object choosing unit 140 may choose the priority control object as follows. In the case of the first risk, the accident occurrence likelihood is divided into high, medium, and low, which are allotted with 5 points, 3 points, and 1 point, respectively. In the case of the second risk, each of a damage scale and an environmental loss value is divided into 0.1 billion won or more, 50 hundred won or more and less than 0.1 billion won, 30 hundred won or more and less than 50 hundred won, 10 hundred won or more and less than 30 hundred won, and less than 10 hundred won, which are allotted with 5 points, 4 points, 3 points, 2 points, and 1 point, respectively. It is assumed that A as a fishing boat has a high accident occurrence likelihood and the damage scale and the environmental loss value when the accident occurs are 10 hundred won and 5 hundred won, respectively. It is assumed that B as an oil tanker has a medium accident occurrence likelihood and the damage scale and the environmental loss value when the accident occurs are 50 hundred won and 0.1 billion won, respectively. When A and B are compared with each other in order to choose the priority control object, A is chosen as the priority object at the time of considering only the first risk, but B is chosen as the priority control object at the time of considering both the first risk and the second risk. The reason is because a total score (12 points=3 points+4 points+5 points) of B is higher than a total score (8 points=5 points+2 points+1 point) of A.

Meanwhile, the priority control object choosing unit 140 may add the weight to each risk at the time of choosing the priority control object. In the exemplary embodiment, a larger weight is applied to the second risk than the first risk. The weight applied to the first risk is in the range of 0.1 to 0.25 and the weight applied to the second risk is in the range of 0.7 to 1. The total score of A is 1.6 points (=0.2×8 points) and the total score of B is 10.8 points (=0.9×12 points) when the weight applied to the first risk is 0.2 and the weight applied to the second risk is 0.9.

Meanwhile, the priority control object choosing unit 140 may reflect the larger weight to the second risk than the first risk.

The first power supply unit 150 performs a function of supplying power to each unit constituting the priority control object choosing apparatus 100.

The first main control unit 160 power supply unit 160 performs a function of controlling overall driving of each unit constituting the priority control object choosing apparatus 100.

The priority control object choosing unit 100 may further include at least one of a risk assuming unit 210, a history analyzing unit 220, and a situation information acquiring unit 230 as shown in FIG. 2A.

The risk assuming unit 210 performs a function of assuming the second risk associated with the damage scale of each moving body or the environmental loss value depending on the damage of the moving body with respect to all the moving bodies in which the first risk is calculated. The risk assuming unit 210 makes the damage scale estimated when the accident occurs or the environmental loss value caused due to the accident for each moving body with respect to various moving bodies into a database and thereafter, assumes the second risk based thereon. In the exemplary embodiment, the risk assuming unit 210 preferably interworks with a database (DB) so as to store the information made into the database. The risk assuming unit 210 converts the assumed damage scale or environmental loss value into a monetary value to calculate the second risk as the amount of money. For example, in the case of the environmental loss value, losses caused due to environmental pollution caused by an accident in which oil is spilled into the sea and fishery stoppage of fishing workers are converted into the monetary value to calculate the amount of money.

The history analyzing unit 220 performs a function of analyzing at least one of a first history associated with the moving body for each moving body in which the accident scenario is assumed, a second history associated with a spot positioned on a movement path of the moving body, and a third history associated with a person who operates the moving body. The first history includes a type depending on a size or volume, an aging level, the number of accidents, a damage scale in the accident, a risk degree depending on whether a hazardous material which may be exploded or fired is loaded, and the like. The second history includes information on an area where accidents among the moving bodies frequently occur, information (ex. information on an area where rocks are a lot) on an area having a natural feature which may cause the accident of the moving body, information on an area where a natural disaster frequently occurs, information on an area where a communication problem is frequently caused, and the like. The third history includes the number of experiences in which the person operating the moving body operated the moving body on the current movement path in the past, the number of experiences in which the person operating the moving body had in the past, and the like.

When the priority control object choosing apparatus 100 further includes the history analyzing unit 220, the risk calculating unit 130 digitizes a result acquired by analyzing at least one history to reflect the analysis result to the first risk at the time of calculating the first risk. Preferably, the risk calculating unit 130 may apply a weight before reflecting the analysis result to the first risk after digitizing the analysis result. In this case, the weight reflected to the history analysis result generally has a value different from the weight reflected to the accident occurrence likelihood, but may have the same value.

For example, the history analysis result may be set as follows. When the first history is the number of accidents, the number of accidents is divided into 0 to once per year, twice to four times per year, and five times or more per year, which are allotted with 1 point, 2 points, and 3 points, respectively. When the second history is the information on the area where the accidents among the moving bodies frequently occur, 1 point is allotted to an area corresponding to the area and 0 point is allotted to an area which does not correspond to the area. When the third history is the number of experiences in which the person operating the moving body operated the moving body on the current movement path in the past, the number of experiences is divided into three times or more, once or more and less than three times, and zero times, which are allotted with 1 point, 2 points, and 3 points, respectively. In the case where the number of accidents is once per year and the number of areas where the accidents among the moving bodies are two on a movement path of C, in C as an oil tanker, the history analysis result of C is 5 points (=1 point+2 points+2 points) when the number of experiences of a person who operates C is one.

The situation information acquiring unit 230 performs a function of acquiring current situation information at a spot positioned on the movement path of the control object moving body. The situation information acquiring unit 230 acquires, for example, current climate information as the current situation information. When the current situation information is acquired for each control object moving body by the situation information acquiring unit 230, the risk calculating unit 130 digitizes the current situation information at the spot positioned on the movement path of each moving body to reflect the digitized information to the first risk. Preferably, the risk calculating unit 130 may apply a weight before reflecting the digitized climate information to the first risk after digitizing the climate information. In this case, the weight reflected to the climate information value generally has a value different from the weight reflected to the accident occurrence likelihood and the weight reflected to the history analysis result, but may have the same value.

When the ships collide with each other on the sea, the collision is caused due to ship operator's careless in most cases.

However, the operator which operates the ship cannot sail intensively every time and it is significantly difficult for the operator to operate the ship by verifying and anticipating all situations generated one by one.

Therefore, it is more effective to verify movements of all ships and foresee the resulting dangerous situation and thereafter, notify the high collision danger likelihood to corresponding ships when a collision danger likelihood is high, in the control center on the land, than to judge whether the corresponding ships collide with each other and the collision is handled, in order to prevent the ships during operation from colliding with each other. Therefore, a sea traffic control system is installed and operated in main domestic and foreign harbors today. The sea traffic control system represents a control system for preventing an inter-collision which may occur while the ships are in operation. The priority control object choosing apparatus 100 is provided in a traffic control center which can communicate with the first moving body and the second moving body. When the moving body is the ship, the traffic control center may be the harbor or the sea traffic control system.

Figure 3:
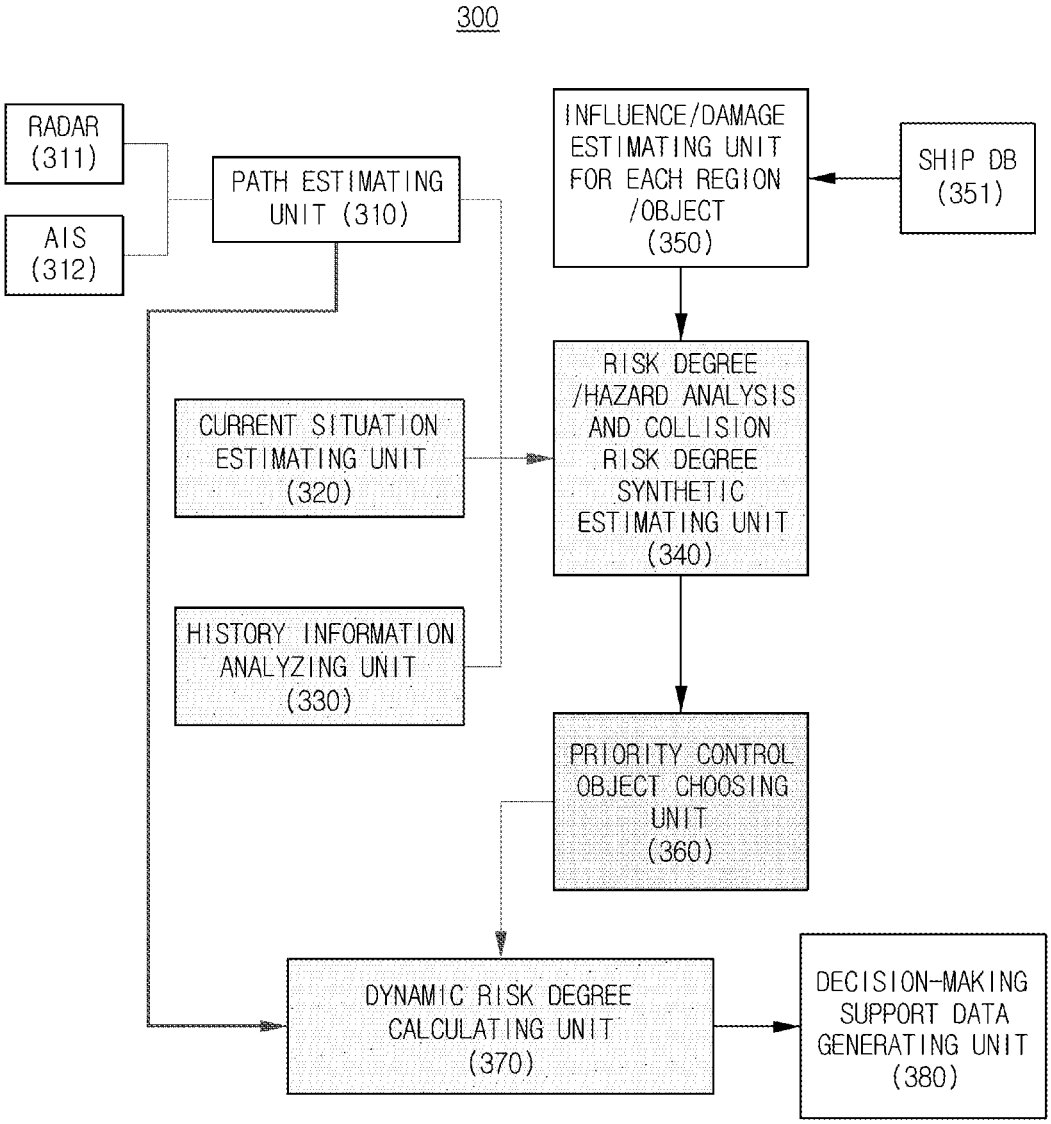
FIG. 3 is an exemplified diagram of the apparatus for choosing a priority control object according to the exemplary embodiment of the present invention.

Next, the priority control object choosing apparatus 100 will be described as an exemplary embodiment. FIG. 3 is an exemplified diagram of the priority control object choosing apparatus according to the exemplary embodiment of the present invention.

FIG. 4 is an exemplified diagram of a list acquired by calculating a risk priority with respect to ships.

FIG. 3 shows an overall flowchart for assuming a main control object of a safe operation system 300 according to the present invention. The safe operation system 300 is a control apparatus for preventing an accident which may occur on a corresponding path by estimating an inter-risk degree when the ship, the airplane, and the like are operated. In more detail, the safe operation system 300 calculates a hazard by combining static/dynamic steering state risk degree, a current situation risk, and a collision risk depending on estimation of an anticipated trajectory with each other, chooses a control concentrated object priority based on the calculated hazard, and performs a control by using the information. The static/dynamic steering state risk degree may be acquired from a damage level for each operation object type, a positional risk for each area/region, and an aging level of an operation object, and the current situation risk is combined with past history information.

A path estimating unit 310 which estimates the movement path of the ship includes a radar 311 and an AIS 312. The path estimating unit 310 identifies a ship therearound by using the radar 311 and the AIS 312 to allow the operator to refer to the identified ship during the operation. The path estimating unit 310 performs the same function as the path estimating unit 110 of FIG. 1.

A current situation estimating unit 320 which performs the same function as the situation information acquiring unit 230 of FIG. 2A may be implemented as a distraction sensing multiple sensor. The distraction sensing multiple sensor may be configured by various sensors including an intelligent optical sensor which is positioned to face the operator. A history information analyzing unit 330 performs the same function as the history analyzing unit 220 of FIG. 2A. An effect/damage estimating unit for each region/object 350 performs the same function as the risk assuming unit 210 of FIG. 2A and a ship DB 351 performs a DB function which interworks with the risk assuming unit 210.

A risk degree/hazard analysis and collision risk synthetic estimation unit 340 which performs the same function as the risk calculating unit 130 of FIG. 1 may be implemented by an intelligent distraction management system. The intelligent distraction management system has operator's recognition as an essential basic function and is a situation recognition system apparatus that may judge a type, a shape, a structure, a feature, a situation, and a degree of distraction determined according to an operation medium. The judgment system is included in a rule processing engine to be continuously and additionally stored so as to increase reliability according to the operator's recognition and judgment result.

When the control system controls the ship as the control object, instantaneous dangerous situations such as the inter-ship collision and stranding occur and concentrativeness of the controllers for handling the dangerous situations has a large influence on handling the accident, and as a result, a ship having the high risk degree and relatively high hazard likelihood is present is primarily controlled. Therefore, the control system requires a scheme to choose a blacklist ship having high risk degree by totally considering a damage caused by the accident of the ship and the accident occurrence likelihood and concentratively control the blacklist ship. In the case of the ship, different damaging effects due to the accidents exist in accidents including the inter-ship collision. For example, damaging effects in the case where oil leaks due to a collision with a large-sized oil tanker and in the case of a collision between small-sized fishing boats are significantly different. Therefore, the dangerous situations may frequently occur at the same time and all dangers may not be handled similarly. It is important to calculate various dangerous elements having high danger occurrence likelihood. A history based hazard needs to be calculated, which is calculated by systematizing past history information of a ship of the aging history, a ship (a ship or an operator/a mate which is not familiar with a sailing geographical feature) which cannot normally perform control instructions or which has no or less port entry history into the corresponding area, or a ship or a mate having the accident history. Therefore, the hazard depending on the danger varies depending on the object, a ship name and a ship type are clearly stated from AIS information in the control, and ship information may be determined. Therefore, the hazard needs to be calculated by totally judging various dangerous elements such as the case in which the dangerous situation may occur and the like as well as the type of the ship.

In general, although analysis of the hazard are expressed differently as necessary, the analysis is expressed as follows in the exemplary embodiment and the damage scale is calculated according to a general calculation method. That is, the exemplary embodiment, the priority of the control object depending on the accident risk degree (likelihood) is chosen and a control method using the chosen priority is concentrated.

Hazard=accident risk degree(likelihood)×estimated damage scale

The estimated damage scale is calculated according to the type of the ship, varies depending on a ship which goes in and out in a corresponding region, and is estimated from an accident for a generally sailing ship in the corresponding region. The accident risk degree is a risk acquired by summing up a risk degree (current risk degree) of a current sea situation, a risk degree (past risk degree) calculated from the past history information, a collision risk degree (future risk degree) for a future moment calculated by anticipating a trajectory, and the like. In the exemplary embodiment, the estimated damage scale, the current risk degree, the past risk degree, and the future risk degree may be calculated by the risk assuming unit 210 of FIG. 2A, the situation information acquiring unit 230 of FIG. 2A, the history analyzing unit 220 of FIG. 2A, and the risk calculating unit 130 of FIG. 1.

The past risk degree as the estimated risk degree from the past history information may be calculated as follows.

Past risk degree=risk degree ($A$) estimated from a action history of a corresponding object during past controlling+accident area history The past history information includes a control history, an entry history, and the like as well as simple accident history. That is, the past history based risk degree (A) includes a control history based risk degree, an output history based risk degree, an accident area history based risk degree, a ship history based risk degree, and the like. The control history based risk degree represents a risk degree based on a veer preference, an abnormal action, an inter-difficulty degree of past communication, whether a communication control event is performed, and a loading transportation history of the dangerous material. The output history based risk represents a risk degree based on the corresponding area entry experience history of the ship and the operator and may be considered that the ship and the operator are not familiar with the sailing geographical feature when the entry history is less. The accident area history based risk degree includes a risk degree based on an accident history of a predetermined area, for example, a collision history in a stranding history area and around a large bridge. The ship history based risk degree represents a risk degree for each ship type based on the aging level of the ship and static and dynamic information depending on a steering feature of the ship.

A current situation accident risk degree may be calculated in addition to the past history. The current situation risk degree represents a current risk degree and may be acquired as follows.

Current risk degree=risk degree calculated from the volume of traffic, waves, weather, wind and waves, fog, and the like in the corresponding area under a current situation The future risk degree as a future collision risk degree depending on the calculation of the trajectory represents a collision risk degree at a future moment calculated depending on the DCPA and the TCPA based on the estimated trajectory among the ships.

From the above, overall calculation of the hazard may be defined as follows.

Hereinafter, α, β, and γ represent weights.

Hazard=estimated damage scale for each ship×((current situation risk degree×α)+(past history based risk degree×β)+(future collision risk degree depending on calculation of trajectory×γ))

In the case of the calculation of the hazard priority for each ship, the hazard priority is calculated from a departure ship in the corresponding region. This function is performed by a priority control object choosing unit 360. The priority control object choosing unit 360 performs the same function as the priority control object choosing unit 140 of FIG. 1. In The case of the ship, the priority list may be calculated as shown in FIG. 4.

The priority control object choosing unit 360 chooses the priority.

A dynamic risk degree calculating unit 370 continuously calculates a risk degree depending on a dynamic path of the priority control object. Although described below, the dynamic risk degree calculating unit 370 performs a function of a moving body controlling unit 610 of FIG. 6A.

A decision-making support data generating unit 380 gives a discriminated sailing support warning for each risk level. Although described below, the decision-making support data generating unit 380 performs functions of a decision-making support data generating unit 640, an accident likelihood extracting unit 650, a decision making supporting unit 660, and the like of FIG. 6B.

Figure 5:
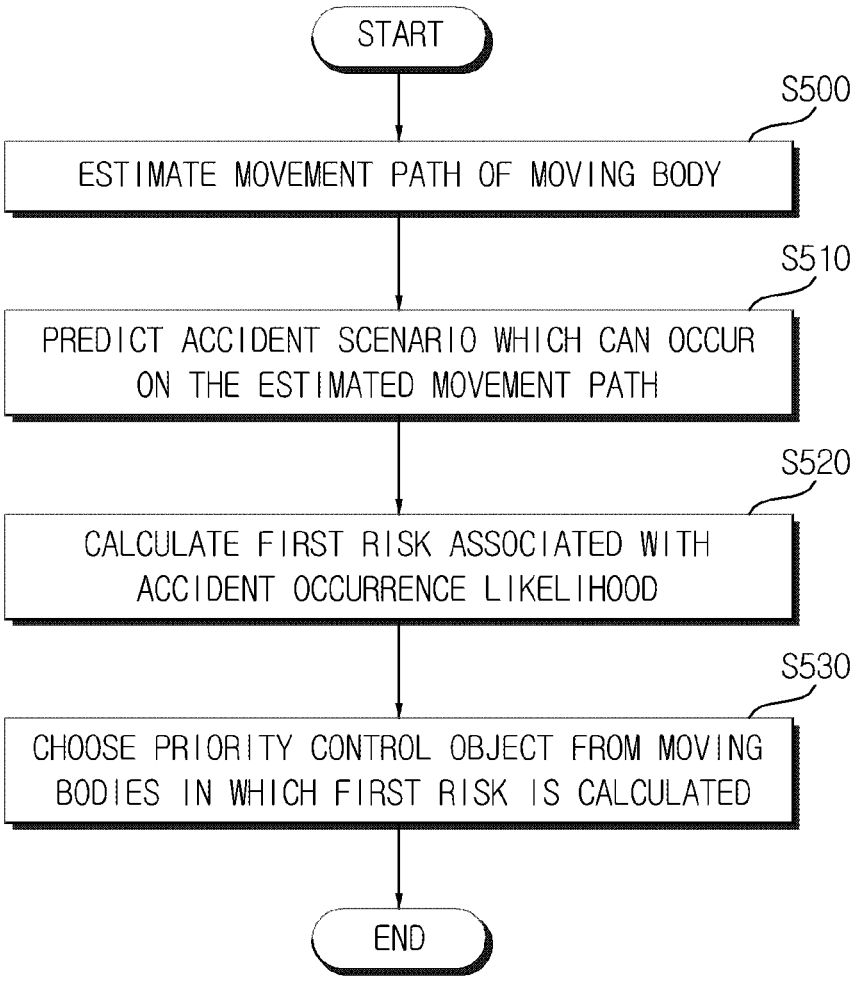
FIG. 5 is a flowchart schematically showing a method for choosing a priority control object according to an exemplary embodiment of the present invention.

Next, a priority control object choosing method of the priority control object choosing apparatus 100 will be described. FIG. 5 is a flowchart schematically showing a priority control object choosing method according to an exemplary embodiment of the present invention.

At present, the control is achieved without relative hazard analysis or risk management reference in the current control system. That is, the control is achieved by a passive method in which more detailed ship information is acquired through clicking the corresponding ship or a ship information menu according to controller's experience or need and the controller concentratively controls the corresponding ship by writing in identification information for visual concentrative observation and verification in the control when the corresponding ship has high hazard. Herein, the priority control object choosing method is contrived to solve the problem and presents a method that can choose a blacklist ship having a high risk degree by totally considering damage caused due to the accident of the ship and an accident occurrence likelihood and perform a concentrated control thereof. The priority control object choosing method is performed by a traffic control center which can communicate with the first moving body and the second moving body.

First, a movement path of a designated first moving body is estimated (path estimating step, S500). At the path estimating step (S500), a movement path of the first moving body is estimated based on a current position of the first moving body. In this case, the path estimating step (S500) may include a position measuring step of measuring the current position of the first moving body every predetermined time and a movement path estimating/adjusting step of estimating the movement path of the first moving body and adjusting the estimated movement path of the first moving body whenever the current position of the first moving body is measured.

After the path estimating step (S500), an accident scenario which may occur on the movement path of the first moving body is predicted based on a previously acquired movement path of at least one second moving body (scenario predicting step, S510).

After the scenario predicting step (S510), a first risk associated with the accident occurrence likelihood of each moving body is calculated based on the accident scenario predicted for each moving body (a risk calculating step, S520). At the risk calculating step (S520), the first risk may be calculated by using a distance of the closet point of approach (DCPA) or a time to the closet point of approach (TCPA). At the risk calculating step (S520), a result of analyzing at least one history is digitized to be reflected to the first risk at the time of calculating the first risk.

After the risk calculating step (S520), when the first risk is calculated with respect to at least one second moving body including the first moving body, the priority control object is chosen among all moving bodies in which the first risk is calculated (priority control object choosing step, S530).

At the priority control object choosing step (S530), the first risk and the second risk may be synthesized with each other at the time of choosing the priority control object or synthesize the first risk and the second risk to which the weight may be synthesized after reflecting the weight to each of the first risk and the second risk.

In this case, at the priority control object choosing step (S530), a larger weight may be reflected to the second risk than the first risk. Meanwhile, the priority control object choosing step (S530) may include a list generating step of generating a priority list in which all the moving bodies in which the first risk is calculated are arranged according to a predetermined priority reference, and a reference conformance object choosing step of choosing a priority control object which conforms to a predetermined choosing reference from the priority list.

In the priority control object choosing method of FIG. 5, a risk assuming step, a history analyzing step, a situation information acquiring step, and the like may be further performed. At the risk assuming step, the second risk associated with the damage scale of each moving body or the environmental loss value depending on the damage of the moving body is assumed with respect to all the moving bodies in which the first risk is calculated. The risk assuming step may be performed between the risk calculating step (S520) and the priority control object choosing step (S530). At the history analyzing step, at least one of a first history associated with the moving body for each moving body in which the accident scenario is assumed, a second history associated with a spot positioned on a movement path of the moving body, and a third history associated with a person who operates the moving body is analyzed. The history analyzing step may be performed between the scenario predicting step (S510) and the risk calculating step (S520). At the situation information acquiring step, current situation information is acquired at a spot positioned on the movement path of the control object moving body. Even the situation information acquiring step may be performed between the scenario predicting step (S510) and the risk calculating step (S520). The situation information acquiring step is generally performed at the same time as the history analyzing step, but may be performed before the history analyzing step or after the history analyzing step.

Figure 6A:
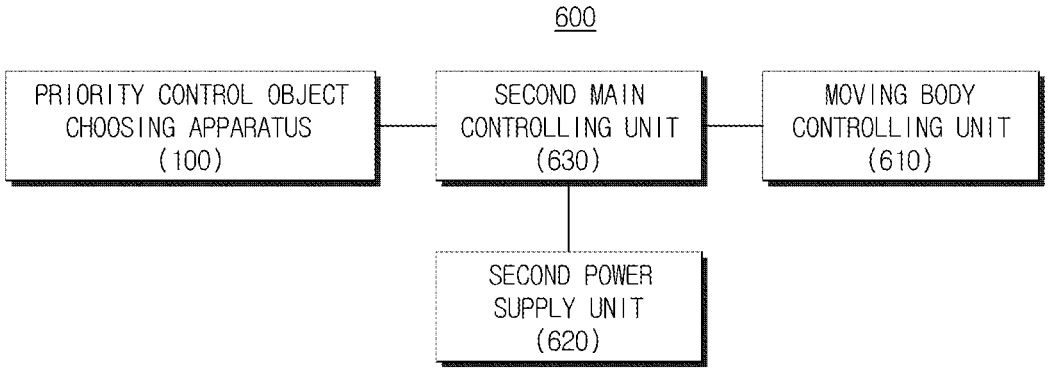
FIGS. 6A and 6B is a block diagram schematically showing an apparatus for controlling an object according to an exemplary embodiment of the present invention.
Figure 6B:
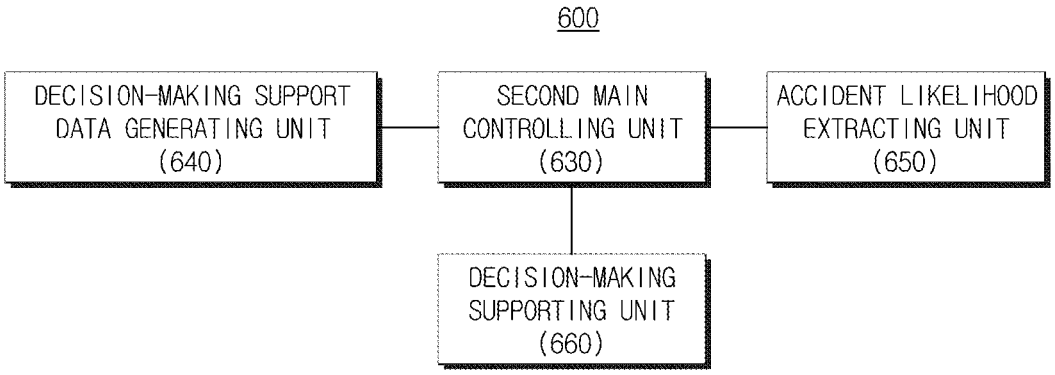

Next, an apparatus for controlling an object that controls the object with the priority control object choosing apparatus of FIG. 1 will be described. FIGS. 6A and 6B is a block diagram schematically showing an apparatus for controlling an object according to an exemplary embodiment of the present invention.

Referring to FIG. 6A, an object controlling apparatus 600 includes a priority control object choosing apparatus 100, a moving body controlling unit 610, a second power supply unit 620, and a second main control nit 630.

The priority control object choosing apparatus 100 has been described above with reference to FIGS. 1 to 4. Therefore, the description thereof will be omitted.

The moving body controlling unit 610 performs a function of performing a first control to estimate again the movement paths of all the moving bodies in which the first risk is calculated based on the current positions of all the moving bodies in which the first risk is calculated every predetermined time, performing a second control to calculate again the first risks of all the moving bodies in which the first risk is calculated, and continuously controlling all the moving bodies in which the first risk is calculated by using a result acquired according to the first control and the second control. The moving body controlling unit 610 may control the priority control object to be again chosen whenever continuously controlling all the moving bodies in which the first risk is calculated.

The second power supply unit 620 performs a function of supplying power to each unit constituting the object controlling apparatus 600.

The second main control unit 630 performs a function of controlling overall driving of each unit constituting the object controlling apparatus 600.

The object controlling apparatus 600 may further include a decision-making support data generating unit 640, an accident likelihood extracting unit 650, a decision making supporting unit 660, and the like as shown in FIG. 6B.

The decision-making support data generating unit 640 performs a function of generating decision-making support data associated with whether there is the accident occurrence likelihood with respect to all the moving bodies in which the first risk is calculated based on the result acquired according to the first control and the second control.

The accident likelihood extracting unit 650 performs a function of extracting moving bodies having the accident occurrence likelihood from all the moving bodies in which the first risk is calculated based on the decision-making support data.

The decision-making supporting unit 660 performs a function of sending a warning message or providing the decision-making support data to the extracted moving bodies. The decision-making supporting unit 660 performs a function of supporting decision-making of a person (ex. controller) who operates each moving body. In this case, the decision-making supporting unit 660 may differentially provide the decision-making support data to the moving bodies according to a degree of the accident occurrence likelihood. The differentially providing of the decision-making support data may for example, provide some of the decision-making support data when the degree is low and all of the decision-making support data when the degree is high.

The decision-making supporting unit 660 may send an accident caution message to at least one moving body positioned within a predetermined distance from the moving body chosen as the priority control target. The decision-making supporting unit 660 sends the accident caution message to moving bodies positioned within several hundreds of meters to several tens of kilometers from a reference moving body. The decision-making supporting unit 660 may differentially send the accident caution message according to the distance from the reference moving body. For example, the decision-making supporting unit 660 may send a message of a temporary stop as the accident caution message to the moving bodies positioned within several hundreds of meters, send a message of a movement path change as the accident caution message to the moving bodies positioned within several kilometers, and send a message of keeping eyes forward to the moving bodies positioned within several tens of kilometers.

Meanwhile, the moving body controlling unit 610 may notify, to the controller, a risk calculation result totally judged with the result acquired according to the first control and the second control in a different warning level and a different warning method. The moving body controlling unit 610 may dynamically generate and manage a blacklist based on the risk calculation result and induce an active control method as well as giving a warning to other moving bodies within a control range when the moving bodies included in the blacklist appear within the control range.

Figure 7:
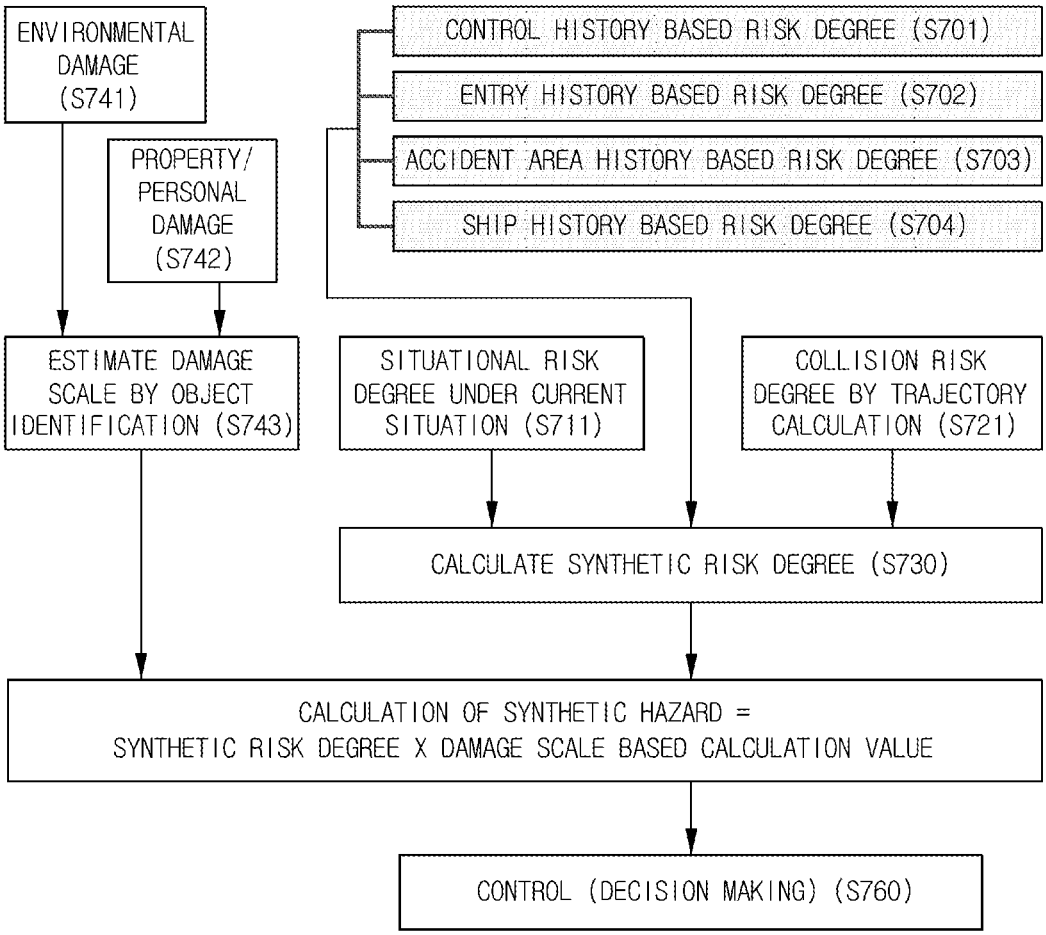
FIG. 7 is an exemplified diagram of a method for controlling an object according to an exemplary embodiment of the present invention.

Next, an object controlling method using the object controlling apparatus of FIGS. 6A and 6B will be described. FIG. 7 is an exemplary diagram of an object controlling method of the object controlling apparatus according to an exemplary embodiment of the present invention. FIG. 7 is flowchart of a method for calculating a synthetic hazard by analyzing history information, current information, and ship information.

The object controlling method proposes a method of estimating a risk degree based on past operation history information as well as an estimated collision risk degree based on an anticipated trajectory, or estimating a risk degree by combining the estimated risk degree with a risk under a current situation or combining all things, in traffic systems of an airplane, a ship, and a vehicle. There is proposed a method of choosing a ranking of objects to be controlled by priority by calculating hazard anticipated based on the estimated risk degree and perform control processing in association with the ranking.

The object controlling method proposes a method of calculating a risk degree or calculating a control blacklist by applying a control history including communication information, a communication time, a communication difficulty degree, and a communication result execution degree with the controller as a control history of the control object at the time of estimating the risk degree based on the past history information. The object controlling method proposes a method of calculating the blacklist or calculating the risk degree by applying accident and incident histories of the control object at the time of estimating the risk degree based on the past history information. The object controlling method proposes a method of calculating the blacklist or calculating the risk degree by applying an entry history of the control object into a corresponding region at the time of estimating the risk degree based on the past history information. The object controlling method proposes a method of calculating the risk degree by applying accident history information for each area in the control region at the time of estimating the risk degree based on the past history information. The object controlling method proposes a method of calculating a base risk degree based on a ship history and calculating the risk degree or calculating the blacklist based on static and dynamic information according to an aging level of the ship and a steering feature of the ship at the time of estimating the risk degree based on the past history information.

The object controlling method proposes a method of dynamically calculating the risk degree from a result of estimating a dynamic path by considering a priority control object list at the time of calculating a dynamic risk degree and using the calculated risk degree in the control. The object controlling method proposes a method of sending a warning differentiated for each risk level by considering the priority control object list or providing sailing support information at the time of calculating the dynamic risk degree.

At step S701, the risk degree is estimated based on the control history and at step S702, the risk degree is estimated based on the entry history. At step S703, the risk degree is estimated based on the accident area history and at step S704, the risk degree is estimated based on the ship history. Steps S701 to S704 are generally performed at the same time, but steps S701, S702, S703, and S704 may be sequentially performed.

After steps S701 to S704 are performed, the risk degree is estimated based on the past history information at step S705. In this case, weights may be applied to the risk degrees acquired through steps S701 to S704, respectively.

Meanwhile, at step S711, a situational risk degree under the current situation, that is, a current risk degree is estimated. In this case, the weight may be applied to the current risk degree. At step S721, a collision risk degree by trajectory calculation, that is, a future risk degree is estimated. The weight may be applied to even the future risk degree.

After steps S705, S711, and S721 are performed, a synthetic risk degree is calculated at step S730.

Meanwhile, an environmental damage is estimated at step S741 and a property/personal damage is estimated at step S742. Thereafter, at step S743, a damage scale by object identification is estimated. In this case, the weight may be applied to each damage.

After steps S730 and S743 are performed, synthetic hazard is calculated at step S750. The synthetic hazard may be acquired by computing (ex. multiplying) the synthetic risk degree and a calculation value based on the damage scale. Thereafter, at step S760, the control (decision making) is performed.

The current system of the sea traffic control center implements a simple trajectory based collision risk degree with respect to approximately 10 ships. The controller judges a dangerous ship by using an empirical method. Therefore, while a ship (ex. oil tanker) having high risk degree is classified as a concentrated dangerous ship, the ship should be controlled. It is necessary to choose and concentratively control ships on the blacklist including a ship having a dangerous accident experience, a ship having an aging experience, a ship which is not familiar with the sailing geographical feature due to less entry experience, a ship that fails to implement a control command in the control, and a ship having a ship history, which has a lot of control communication contents and does not take active cautions. All areas where the dangerous accident frequently occurs may be developed to an expert system through data mining in associated with the history, to thereby sort the ship having the high risk degree. Meanwhile, it is difficult to continuously monitor all ships. The reason is that the number of ships to be managed is approximately 10,000. It is preferable that ships positioned in dangerous areas or ships classified as dangerous ships according to the history should be primarily monitored and the monitoring should be applied and developed in the system. The ship control is most needed in the control.

The present invention can be applied to an airplane control similarly in addition to the ship control and can more effectively prevent the accident.

In the related art, the control was not performed by calculating the synthetic risk degree as described above and the system estimated trajectories of respective ships and only when a scenario in which the estimated trajectory met other ships was anticipated, a risk degree calculated based distances among the ships and the time and was calculated. Therefore, depending on a harbor area, in an area having a lot of narrow channels, such as a harbor limit in Korea, a lot of warnings are similarly generated with respect to ships which generally pass adjacent to the area, and as a result, most controllers turns off a warning sound or do not use the function itself in most cases. All the risks are not assessed by lust considering the ship type.

In the present invention, provided is a control method which calculates the risk degree combined with the past history information and calculates the risk degree under the current situation to calculate the synthetic hazard by combining and combines the calculated risk degree with the risk degree by the trajectory calculation, and adopt the calculated hazard. The present invention can be applied to an intelligent situation recognition based operation system and a control technology field that avoid the risk and prevent the accident by determining risk based hazard which can be applied to a ship traffic on the sea, the airplane control in the air, and a vehicle operation on the land. In particular, the present invention can be applied to a vessel traffic service (VTS, sea traffic control service), a u-VTS, and the like for implementing sea safety. The present invention can be applied under various application environments in which important monitoring is performed and can be utilized in even all processors in which the controller (surveillant) calculates and manages an importance depending on respective calculated systematic risks to process the control.

As described above, the exemplary embodiments have been described and illustrated in the drawings and the specification. The exemplary embodiments were chosen and described in order to explain certain principles of the invention and their practical application, to thereby enable others skilled in the art to make and utilize various exemplary embodiments of the present invention, as well as various alternatives and modifications thereof. As is evident from the foregoing description, certain aspects of the present invention are not limited by the particular details of the examples illustrated herein, and it is therefore contemplated that other modifications and applications, or equivalents thereof, will occur to those skilled in the art. Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. An apparatus for choosing a priority control object to be controlled, comprising:

a path estimating unit configured to estimate a movement path of a moving body of a plurality of controllable bodies, each controllable body configured to move independently of each other controllable body;

a scenario predicting unit configured to predict an accident scenario which can occur on the movement path, the accident scenario involving each of the plurality of controllable bodies;

a risk calculating unit configured to calculate a first risk associated with an accident occurrence likelihood of each of the plurality of controllable bodies based on the accident scenario;

a priority control object choosing unit configured to choose a priority control object to be controlled from the plurality of controllable bodies using the first risk of each of the plurality of controllable bodies; and a risk assuming unit configured to assume a second risk associated with a damage scale of the moving body or an environmental loss value, the environmental loss value depending on a damage to an environment associated with the moving body, the accident scenario, or both, wherein the priority control object choosing unit is configured to synthesize the first risk and the second risk at the time of choosing the priority control object or synthesize the first risk and a weighted second risk calculated by applying a weight to the second risk.

2. The apparatus of claim 1, further comprising:

a history analyzing unit of analyzing at least one of a first history of accidents associated with the moving body, a second history of accidents associated with a spot positioned on the movement path, and a third history associated with experiences of a person who operates the moving body.

3. The apparatus of claim 1, further comprising:

a situation information acquiring unit acquiring current situation information at a spot positioned on the movement path.

4. The apparatus of claim 1, wherein the risk calculating unit calculates the first risk by using a distance of the closet point of approach (DCPA) or a time to the closet point of approach (TCPA).

5. The apparatus of claim 1, wherein the priority control object choosing apparatus is provided in a traffic control center which is able to communicate with each of the plurality of controllable objects.

6. The apparatus of claim 1, wherein:

the path estimating unit is configured to estimate the movement path based on a current position of the moving body, and the path estimating unit includes:

a path estimating unit configured to measure the current position of the first moving body every predetermined time; and a movement path estimating/adjusting unit configured to estimate the movement path of the moving body and adjust the movement path whenever the current position of the moving body is measured.

7. The apparatus of claim 1, wherein the priority control object choosing unit includes:

a list generating portion configured to generate a priority list in which all of the plurality of controllable bodies are arranged according to a predetermined priority reference; and a reference conformance object choosing portion configured to choose the priority control object in accordance with a predetermined choosing reference from the priority list.

8. The apparatus of claim 2, wherein the risk calculating unit is configured to calculate the first risk using a result acquired by analyzing at least one of the first through third histories.

9. A method for choosing a priority control object, comprising:

estimating a movement path of a moving body of a plurality of controllable bodies, each controllable body configured to move independently of each other controllable body;

predicting an accident scenario which can occur on the movement path, the accident scenario involving each of the plurality of controllable objects;

calculating a first risk associated with an accident occurrence likelihood of each of the plurality of controllable objects based on the accident scenario; and assuming a second risk associated with a damage scale of the moving body or an environmental loss value, the environmental loss value depending on a damage to an environment associated with the moving body, the accident scenario, or both; and choosing a priority control object to be controlled from among the plurality of controllable bodies by synthesizing the first risk and the second risk of each of the plurality of controllable bodies or synthesizing the first risk and a weighted second risk calculated by applying a weight to the second risk.

10. The method of claim 9, further comprising:

analyzing at least one of a first history of accidents associated with the moving body, a second history of accidents associated with a spot positioned on the movement path, and a third history associated with experiences of a person who operates the moving body.

11. The method of claim 9, further comprising:

acquiring current situation information at a spot positioned on the movement path.

12. An apparatus for controlling an object, comprising:

a path estimating unit configured to estimate a movement path of a moving body of a plurality of controllable bodies, each controllable body configured to move independently of each other controllable body;

a scenario predicting unit configured to predict an accident scenario which can occur on the movement path, the accident scenario involving each of the plurality of controllable bodies;

a risk calculating unit configured to calculate a first risk associated with an accident occurrence likelihood of each of the plurality of controllable bodies based on the accident scenario;

a priority control object choosing unit configured to choose a priority control object from the plurality of controllable bodies using the first risk of each of the plurality of controllable bodies; and a moving body controlling unit configured to perform a first control to estimate again the movement paths of all moving bodies of the plurality of controllable bodies based on the current positions of all the moving bodies of the plurality of controllable bodies every predetermined time, perform a second control to calculate again the first risks of all the moving bodies of the plurality of controllable bodies, continuously control all the moving bodies of the plurality of controllable bodies using the result acquired according to the first control and the second control, and to notify, to a controller, a risk calculation result synthetically judged with the result acquired according to the first control and the second control in different warning level and method.

13. The apparatus of claim 12, further comprising:

a decision-making support data generating unit configured to generate decision-making support data associated with whether there is the accident occurrence likelihood with respect to all the moving bodies of the plurality of controllable bodies based on the result acquired according to the first control and the second control;

an accident likelihood extracting unit configured to extract moving bodies having the accident occurrence likelihood from all the moving bodies of the plurality of controllable bodies based on the decision-making support data; and a decision-making supporting unit configured to send a warning message or providing the decision-making support data to the extracted moving bodies.

14. The apparatus of claim 13, wherein the decision-making supporting unit is configured to send an accident caution message to at least one of the plurality of controllable bodies positioned within a predetermined distance from the priority control target.

15. The apparatus of claim 12, wherein the moving body controlling unit is configured to control the priority control object to be again chosen whenever continuously controlling all the moving bodies of the plurality of controllable bodies.

16. The apparatus of claim 12, wherein the moving body controlling unit is configured to dynamically generate and manage a blacklist based on the risk calculation result, and to induce an active control method as well as giving a warning to other moving bodies of the plurality of controllable bodies within a control range when a moving body included in the blacklist appears within the control range.

* * * * *